US006129487A

United States Patent [19]

Bermingham et al.

[11] Patent Number: 6,129,487

[45] Date of Patent: Oct. 10, 2000

[54] UNDERWATER PILE DRIVING TOOL

[75] Inventors: Patrick Bermingham, Hamilton; Matthew Janes, Etobicoke, both of Canada; Geert Jonker, Smitweg; Peter Middendorp, Rijswijk, both of Netherlands

[73] Assignee: Bermingham Construction Limited, Canada

[21] Appl. No.: 09/127,026

[22] Filed: Jul. 30, 1998

[51] Int. Cl.[7] ..... B25D 9/04; B25D 9/14; E02D 9/02; E02D 11/00; G01N 3/34

[52] U.S. Cl. ..... 405/228; 175/5; 175/10; 73/11.03; 173/DIG. 1

[58] Field of Search ..... 405/228; 175/5, 175/10; 73/11.03; 173/81, DIG. 1

[56] References Cited

U.S. PATENT DOCUMENTS

| | | | |
|---|---|---|---|
| 3,170,433 | 2/1965 | Gardiner | 114/295 |
| 3,399,646 | 9/1968 | Vincent | 114/295 |
| 3,646,598 | 2/1972 | Chelminski | 405/228 |
| 3,800,548 | 4/1974 | Wisotsky | 405/228 |
| 3,817,335 | 6/1974 | Chelminski | 173/127 |
| 3,820,346 | 6/1974 | Wisotsky | 405/228 |
| 3,824,797 | 7/1974 | Wisotsky | 405/228 |
| 3,958,647 | 5/1976 | Chelminski | 173/127 |
| 3,970,156 | 7/1976 | Niskin | 175/6 |
| 3,998,064 | 12/1976 | Jansz | 405/228 |
| 4,060,139 | 11/1977 | Adair | 173/137 |
| 4,098,355 | 7/1978 | Gendron et al. | 173/DIG. 1 X |
| 4,238,166 | 12/1980 | Gendron | 405/228 |
| 4,362,439 | 12/1982 | Vaynkof | 405/228 |
| 4,619,218 | 10/1986 | Kenny | 405/228 |
| 4,682,559 | 7/1987 | Schnitzer et al. | 114/295 |
| 4,817,734 | 4/1989 | Kuehn | 173/DIG. 1 X |
| 4,818,149 | 4/1989 | Kuehn | 405/228 |
| 4,844,661 | 7/1989 | Martin et al. | 405/228 X |
| 4,845,996 | 7/1989 | Bermingham | 73/807 |
| 4,872,514 | 10/1989 | Kuehn | 173/DIG. 1 X |
| 5,704,732 | 1/1998 | Horton, III | 405/228 |
| 5,725,329 | 3/1998 | Chelminski | 405/228 X |
| 5,915,883 | 6/1999 | Kuehn | 405/228 X |

FOREIGN PATENT DOCUMENTS

| | | |
|---|---|---|
| 7902425 | 1/1979 | France . |

*Primary Examiner*—Eileen D. Lillis
*Assistant Examiner*—Tara L. Mayo
*Attorney, Agent, or Firm*—Fish & Richardson P.C.

[57] ABSTRACT

A tool is provided for use in submerged condition for installing anchor or foundation elements such as piles in a ground formation that is submerged under a body of water. A hammer body is fixedly supported in axial alignment with the head of a pile that is to be driven and carries a reaction body guided for movement thereon in a direction that is axial to the pile. The hammer body and reaction body define opposed first and second ends of an expansion chamber. A pyrotechnic charge is initiated to create a rapidly expanding volume of high pressure gas in the expansion chamber to generate a downwards pressure force pulse to drive the pile, an equal and opposite upwards pressure force pulse being applied to the reaction body. Damping structure operatively associated with the reaction body interacts with the water in which the tool is submerged using the inertia of the water to resist upwards movement of reaction body.

10 Claims, 8 Drawing Sheets

UNDERWATER PILE DRIVING TOOL

BACKGROUND OF THE INVENTION

1. Field of the Invention

This invention relates to a new or improved tool for installing piles in underwater ground (i.e. soil or rock) formations, and to a method for utilizing such a tool.

2. Description of the Prior Art

Offshore structures, vessels and floating rigs require anchoring points to safely moor or position them in situ, or to offer resistance to allow rig repositioning or movement. Known anchoring systems use fluke, gravity or suction type anchors or driven foundation piles to provide resistance to lateral or tension loads. Fluke, gravity and suction anchors provide limited and unquantified pull-out resistance, and have been installed in various ways, e.g. by dragging flukes into the sea bed, or by suctioning structures into the sea bed. A notable disadvantage of these anchors is the fact that they are only effective to take up horizontal forces so that the horizontal spacing between the anchor points and the structure that is being anchored needs to be very large. The present invention overcomes this disadvantage, so that there results a large saving in the costs for anchoring ropes or cables.

Efforts have been made to use explosives, pneumatic and hydraulically powered systems to shoot anchors into the sea bed, examples of these being seen in U.S. Pat. Nos. 3,170,433 Gardiner, 4,619,218 Kenny and 4,682,559 Schnitzer et al.

Shallow water systems may make use of piles driven and/or drilled into the ocean floor to provide resistance to compression, tension, or lateral loads, which they can do effectively. However in deep sea and ultra-deep environments, increased installation costs limit the use of subsea pile driving hammers for piled foundations. As is well understood, a pile driver system operates through the repeated striking of a foundation element with blows or forces of high magnitude, thus advancing the foundation element into the ground in increments. The kinetic energy output of a pile driver is a function of its ram mass and the velocity of the ram at impact. Pile driving is accomplished through transmission of the kinetic energy of the pile driver to the pile to overcome resistance and loss forces and impart a displacement to the pile.

Conventional inland pile drivers do not operate efficiently under water, and for such applications specialized underwater pile drivers have been developed, examples of these being seen in U.S. Pat. Nos. 4,238,166 Gendron and 4,362,439 Vaynkof.

It is the object of the present invention to provide a novel method and apparatus for the installation of piles and other types of foundation elements into the sea bed. Desirably the system will be portable so that it can be readily transferred between different locations for the installation of foundation elements. Also within the scope of the invention drive systems can be developed which are compatible with highly inflammable environments.

The invention provides a tool for use in submerged condition for installing piles and other types of foundation elements into a ground formation that is submerged under a body of water, comprising: a hammer body that is adapted to be fixedly supported relative to and in axial alignment with the head of a pile that is to be driven; a reaction body carried by said hammer body and guided for movement thereon in a direction that is axial to the pile that is to be driven; said hammer body and said reaction body respectively defining opposed first and second ends of an expansion chamber that is formed therebetween; charging means for creating a rapidly expanding volume of high pressure gas within said expansion chamber to generate a downwards pressure force pulse on said expansion chamber first end to drive the pile, an equal and opposite upwards pressure force pulse being applied to said reaction body through said second end of the expansion chamber; and damping structure operatively associated with said reaction body and configured to interact with the water in which the tool is submerged to resist upwards movement of said reaction body in response to such upwards pressure force pulse.

Preferably the charging means comprises a series of combustible propellant charges each arranged within a firing chamber which communicates with the expansion chamber through a connecting passage to deliver high pressure gas to the expansion chamber upon initiation of the respective charge. The charging chambers can be arranged in a housing that surrounds the reaction body, each firing chamber communicating with the expansion chamber through a non-return valve. A fuel igniter in each firing chamber is connected to an igniter control on the tool, and the igniter control is arranged for remote actuation, e.g. through a cable leading to the surface or to a WROV (working remote operated vehicle), or by wireless arrangements involving radio frequency waves.

The damping structure is preferably a large volume container that has an open top and that is positioned on the reaction body. The container itself although large can be thin-walled and relatively lightweight, but will enclose a very large mass of water the inertia of which is used to resist upward displacement of the reaction body. The bottom of the container preferably has a series of valve ports extending upwardly therethrough each valve port having a valve closure mounted to permit flow of water upwardly into the container, but to prevent flow of water downwardly out of the container. Thus the valve arrangement allows the container to settle downwards again rapidly, after an upwards displacement in response to firing of a propellant charge.

It will be understood that the pressure pulses provide a repeatable downwards thrust or push upon the pile, and that this thrust is generated by a mechanism which does not require any ram or movable striking or oscillating part or other mechanism to transfer kinetic energy to the foundation element. Rather the thrust is created through the pressurized gas acting downwardly onto the pile, this gas being contained within the tool mechanism which remains a separate entity from the foundation element or pile that is being installed.

The hammer body and the reaction body together provide a mated and guided piston and cylinder pressure vessel, the parts of which remain connected throughout use, although being free for axial movement relative to one another.

The direction of the applied load to the foundation element is easily determined and controlled through positioning and alignment of the tool, and although for convenience of description the terms "upwardly" and "downwardly" and the like are employed herein it will be understood that the disclosed method and apparatus is not restricted to the driving of foundation elements vertically, but is also useful where the foundation elements are to be installed in angled or even horizontal orientations.

The composition and size of each propellant charge can be adjusted as desired to provide the desired impulse shape (as to duration and magnitude) best suited to the geotechnical conditions at hand.

Resistance to the upward reaction force is provided by the mass of water which is within the container and which provides a combined inertial and drag resistance to the acceleration and motion of the contained mass through the water. Motion of this resistance system is designed and desired to occur as a consequence of the large reaction thrust load. The magnitude of the motion is intended to be high such that during the thrust application the resistance system is accelerated through the water, in vertical installations the container being restored to its start position under the force of gravity.

Angled deployment of foundation elements such as piles may be obtained by ballasting and similar controlled initial penetration of the foundation element. The desired inertial and drag resistance of the container will still be achieved even when angled, but in such applications some force mechanism such as spring means may be required to restore the container to its starting position.

The tool is readily adaptable to include electronic transducer systems to measure load and position (displacement) of the foundation element over time, i.e. prior to, during, and after each successive thrust. Continuous monitoring, recording and analysis of the applied thrust loads and foundation element advance is provided remotely from the operating station. Thus a complete foundation penetration record can be provided which gives high quality assurance and certification of ultimate attained foundation capacity and stiffness. Due to such certification, piles can also be installed at places where only limited soils information is available. In other words less soils information is needed to ensure that a safe and acceptable anchoring point or foundation pile is achieved.

The invention will further be described, by way of example only, with reference to the accompanying drawings wherein.

Figure 1:
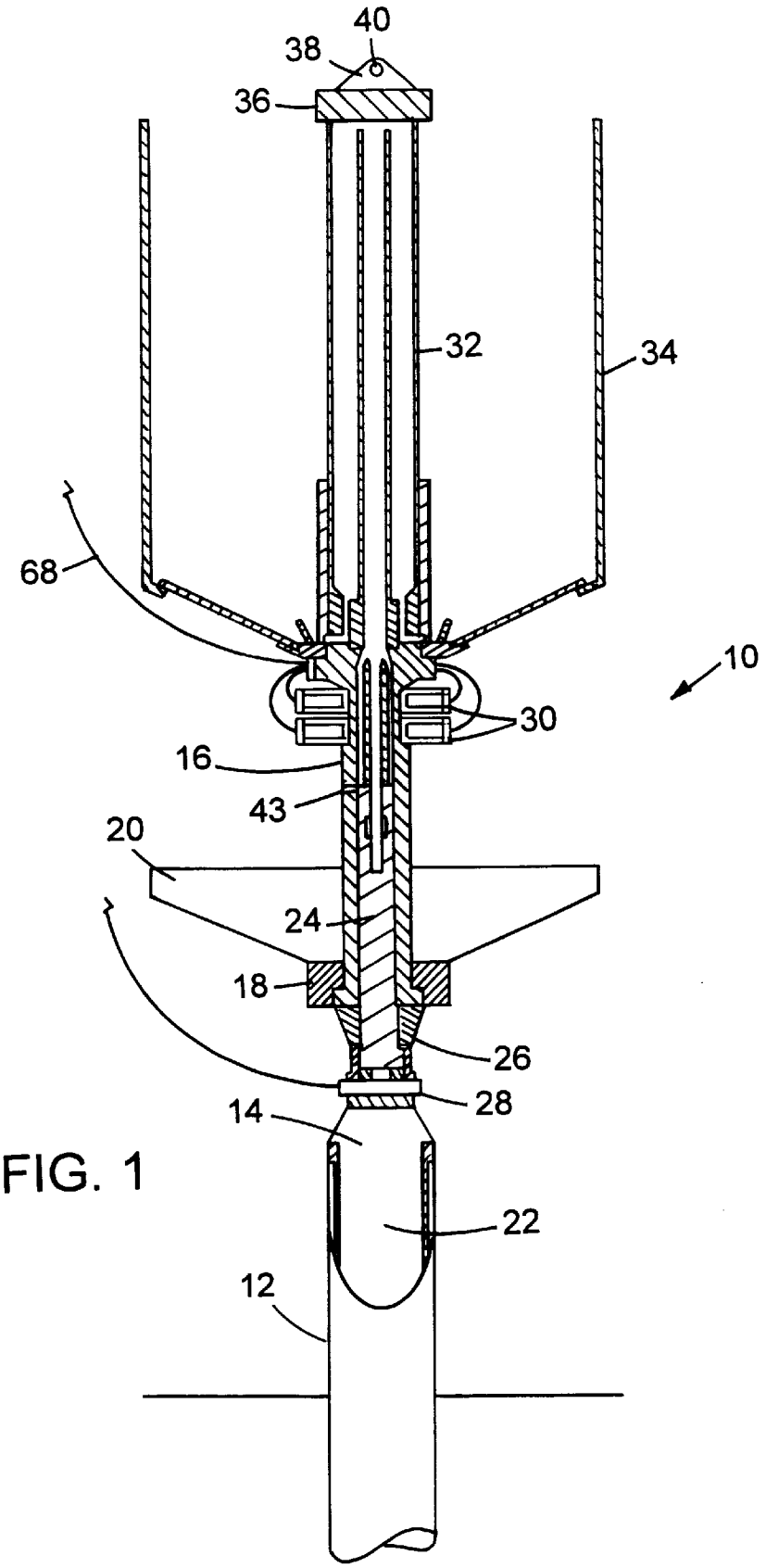
FIG. 1 is a longitudinal sectional view of a preferred embodiment of the tool for underwater installation of foundation elements.

Referring to FIG. 1, the tool 10 is shown in position for installing a pile 12 in an underwater ground formation, the tool being supported on the top of the pile by a pile cap 14. The pile cap 14 fits closely within the open top of the pile and provides means of alignment of load transfer with the pile.

The tool 10 comprises a relatively slender cylindrical body 16 at the lower end of which is a collar 18 that supports a large diameter generally disc-shaped drag reaction plate 20 surrounding the cylinder and having an upper side that is generally at right angles to the common axis 22 of the tool and pile, and having an underside that is somewhat angled so that the thickness of the drag reaction plate tapers in the radially outwards direction.

Within the tool cylinder 16 there is a coaxially arranged piston 24 which extends downwardly through a locking collar 26 at the lower end of the cylinder and which rests upon an accelerometer and load cell instrumentation disc 28 which is supported on top of the pile cap 14.

The upper end of the cylinder 16 is surrounded by an array of charge cylinders 30 by means of which the tool is powered, and above these there is an upwardly projecting central plenum chamber 32 that is surrounded by a large diameter open top reaction mass container 34. The upper end of the plenum chamber 32 is closed by a cap 36 which includes an upstanding plate 38 formed with an eye 40 providing a means through which the tool 10 can be raised or lowered e.g. on a cable or the like (not shown).

Figure 2:
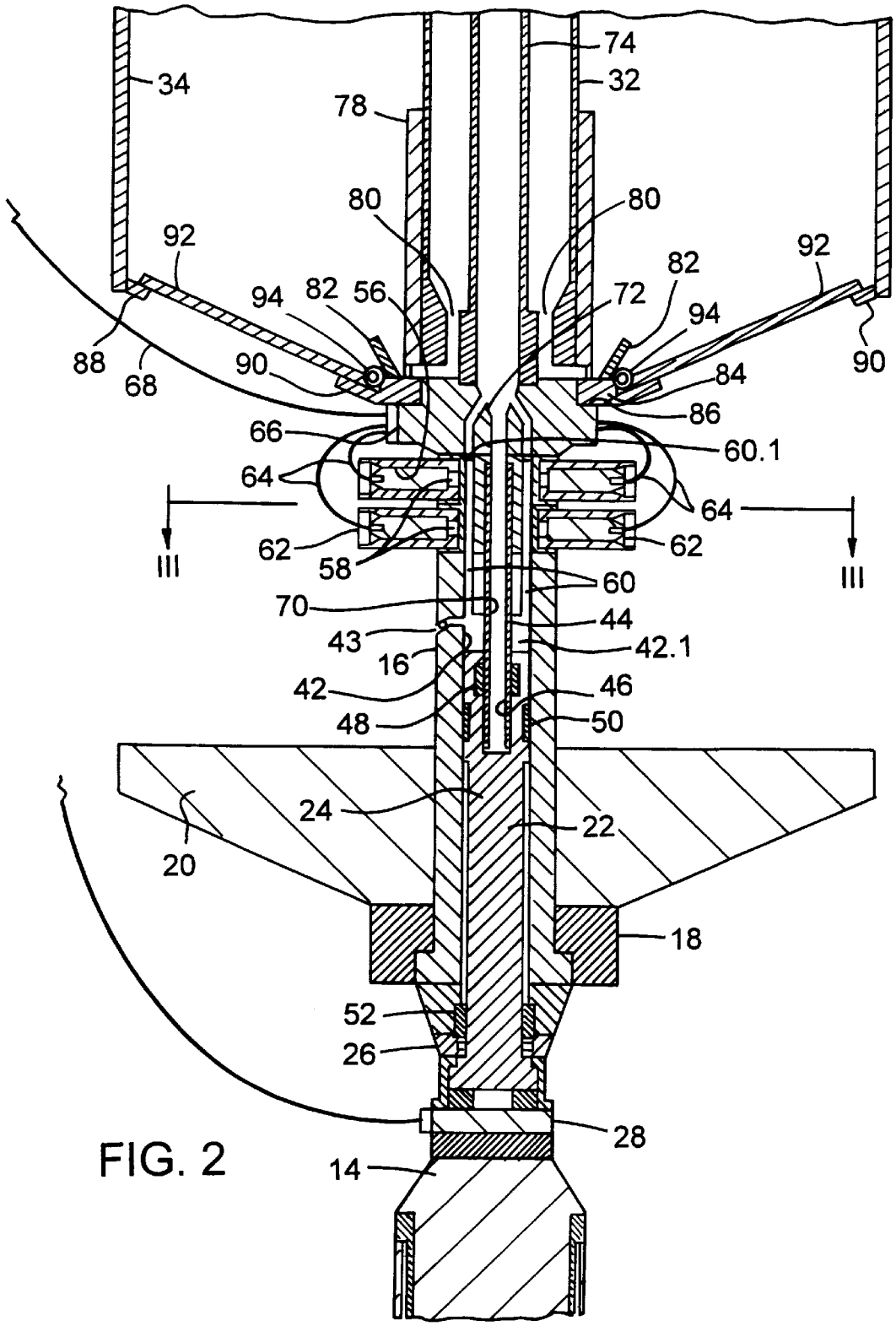
FIG. 2 shows a portion of FIG. 1 to a larger scale.

Details of the tool are shown more clearly in FIG. 2 where it can be seen that the cylinder 16 has an internal bore 42 which defines a chamber one end of which is closed by the upper end of the piston 24 and the other end of which is formed in the cylinder or on parts associated therewith. It will be understood that the chamber 42.1 enclosed by the bore 42 is expansible by movement of the piston 24 axially with respect to the cylinder 16, FIG. 2 showing this chamber at its minimum size with the piston 24 fully retracted within the cylinder 16. In this condition, an axial vent tube 44 fixed to the cylinder 16 is received in an axial bore 46 in the piston 24 and sealed thereto by a seal 48. A pressure relief passage 43 extends through the wall of the cylinder 16 from the chamber 42.1 to the exterior, this passage 43 being controlled by a check valve (not shown) which allows flow outwardly through the passage 43 but prevents flow inwardly. A further annular seal 50 carried by the piston cooperates with the chamber wall 42, and an annular seal 52 carried on the cylinder cooperates with the outer cylindrical surface of the piston 24.

Figure 3:
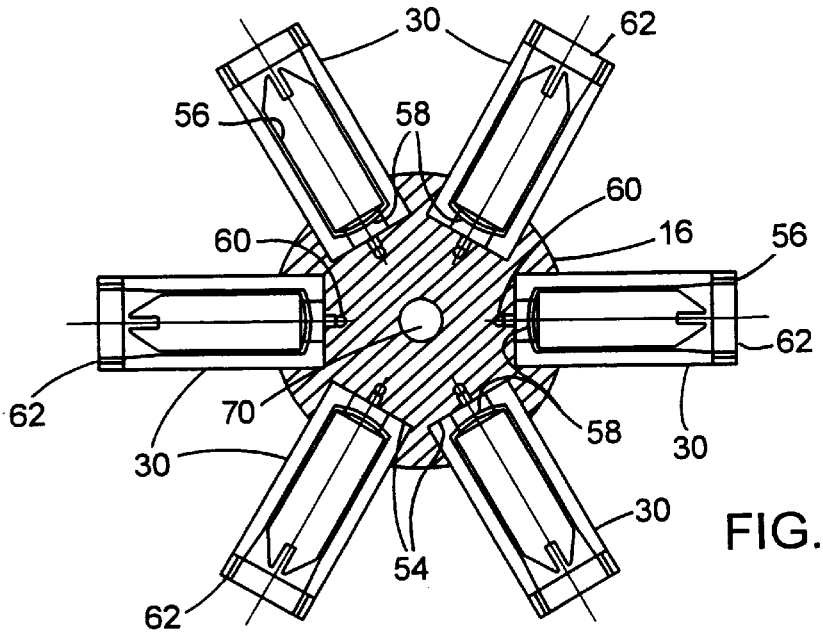
FIG. 3 is a sectional view taken generally on the line III—III in FIG. 2.

As shown also in FIG. 3 the charge cylinders 30 are arranged radially with respect to the cylinder 16 being affixed thereto in two banks each of six charge cylinder as indicated in FIG. 2. Each cylinder 30 has a radially inner end received in a socket 54 in the tool cylinder 16 and has a bore 56 to receive the propellant charge 57, this bore communicating through a non-return valve 58 to a respective one of a series of axially extending passages 60 which open into the chamber 42. The upper ends of these passages 60 extend into the exhaust plenum 74, however communication with the exhaust plenum 74 is prevented by a number of rupture discs 60.1 one of which is arranged in each of the passages 60. These rupture discs 60.1 act as safety pressure release valves normally blocking any flow from the passages 60 to the exhaust plenum 74, but in the event of a predetermined overpressure in the passage 60 rupturing to allow pressure release.

At the radially outermost end of each of the charge cylinders 30 is embedded a fuel igniter 62 each of which is connected through a respective ignition cable 64 to an ignition control box 66 connected to a remote location (e.g. on the surface of the body of water) through a master ignition cable 68.

The bore 70 of the thin walled vent tube 44 extends upwardly through the top end of the cylinder where it widens through a transition zone 72 and opens into the lower end of a tube 74 that extends axially upwards within the plenum chamber 32, the upper end 76 of the tube terminating at a spacing from the cap 36. The lower end of the plenum chamber tube 32 is received within a short cylindrical sleeve 78 and is formed at its lower end with a series of L-shaped passageways 80 which extend first axially and then radially outwardly through the chamber 36 and the sleeve 78, there being a series of angled deflectors 82 positioned around the lower end of the sleeve 78 in register with the passageways 80.

The angled deflectors are mounted in a central hub 84 which forms the lower end of the container 34 and which is seated in an annular shoulder 86 formed in the upper end of the cylinder 16. The lower end of the container 34 includes an upwardly and outwardly angled wall 88 formed with a plurality of large ports 90 therein, each port being closable by means of a correspondingly sized hatch plate 92 having a pivotal mounting 94 on the hub 84.

To generate a downwards thrust for driving the pile 12 into the undersea ground formation, a fuel charge 57 positioned in a charge cylinder 30 is initiated by means of a control signal sent through the master ignition cable 68 the ignition control box 60 and the appropriate ignition cable 64 to the fuel igniter 60. When ignited the charge 57 very rapidly produces a large volume of expanding gas which exits through the associated non-return valve 58 and axial passage 60. At the time of initiation, the parts occupy the positions as shown in FIG. 2 so that with the vent tube 44 sealed in the bore 46 of the piston, the expanding gas produced by ignition of the fuel charge produces a very rapid rise in the pressure within the cylinder chamber 42, producing a corresponding downwards thrust on the piston 24 and hence to the pile 12, which will drive the pile into the soil formation by an incremental distance which will be in inverse proportion to the soil resistance. The composition of the fuel charges 57 can be varied widely according to the thrust characteristics that are to be achieved. Typically the fuel charge 57 will comprise a nitro cellulose double base propellant examples of which are available commercially from numerous sources.

An equal and opposite upwards thrust is applied to the cylinder assembly 16 to produce an upwards displacement of the latter, this upwards displacement being resisted by the inertia of the cylinder assembly 16 and the parts associated therewith. In the absence of the water in which the tool is immersed, a very large upwards displacement would result. However the tool as described above is designed to take advantage of the inertial and drag forces that can be created through interaction with the water in which the tool is immersed so that the upwards displacement is restricted to a manageable amount.

Figure 4:
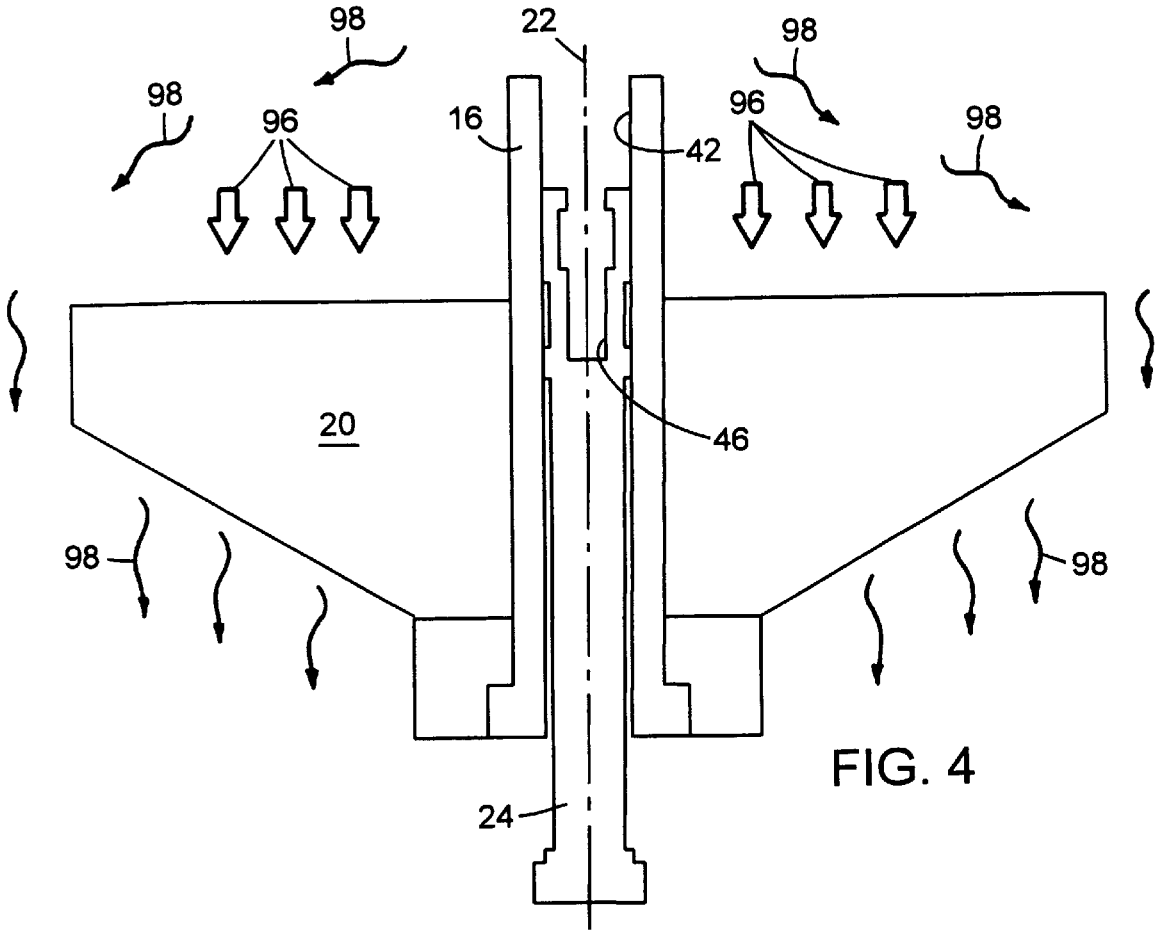
FIG. 4 is a view representing reaction forces on the reaction body which arise during operation of the tool.

Referring to FIG. 4 it will be appreciated that the upwards thrust applied to the cylinder 16 will be resisted by the inertia of the water that is positioned above the drag reaction plate 20, an indicated by the heavy black arrows 96, since water present at that location will have to be displaced before the plate 20 (and hence the cylinder 16) can move upwardly. Additionally, once the plate 20 commences upwards movement in response to the thrust, drag resistance will be created through interaction of the plate with the surrounding water, as indicated by the arrows 98.

Similarly the container 34 will enclose by its sides and bottom a very large volume of essentially stationary water, and the inertia of this water volume will have to be overcome before the container and cylinder assembly 16 can move upwardly. Although the container 34 is thin walled, it must be of sufficiently rigid construction to resist the inertial forces of the contained water when the container 34 is thrust upwardly by the cylinder 16. Furthermore, it will be understood that when the container does commence moving upwardly there will be drag forces which arise as a result of the engagement of the water on the outer side of the container 34.

As explained, the pressure within the chamber 42 will rise rapidly after initiation of one of the charges 57, the rate and duration of this pressure increase being governed by the composition and size of the charge 57 as well as the physical dimension of the passages 60, the chamber 42 etc. With relative displacement between the cylinder 16 and the piston 24, the volume of the chamber 42 will increase, and the pressure within it will continue to rise as the fuel charge burns, since the chamber is essentially closed. However once the displacement has proceeded to an extent wherein the lower end of the vent tube 44 passes above the upper surface of the piston 24, the high pressure gases within the chamber 42 can discharge through the bore 70 of the vent thus terminating the pressure rise within the cylinder 2. From the bore 70 the gases expand through the transition 70 into the interior of the plenum chamber tube 74 and thence to the annular space between the latter and the outer tube 32 to be vented through the L-shaped passages 80 into the surrounding water. This pressure release will continue until the pressure within the cylinder chamber 42 becomes equalized with the pressure of the surrounding water. After the venting action is complete, the upwardly displaced cylinder assembly (having an overall negative buoyancy) will have a tendency to sink under its own weight back to the starting position shown in FIG. 2. During this descent the hatch plates 92 can pivot away from the closed positions shown in FIG. 2 allowing water to flow freely through the lower wall of the container 34 to reduce resistance of movement of the assembly downwardly. The cylinder chamber 42 vents freely through the vent tube 44 as the cylinder descends on the piston. However once the tube 44 re-enters the bore 46 in the cylinder this flow is cut off, and to enable the cylinder assembly 16 to continue to descend, gas from the cylinder chamber 42 is expelled through the pressure relief passage 43. It will be appreciated that during operation of the apparatus, there will be a certain amount of leakage of high pressure gas through the passage 43, but this leakage is insignificant since the passage 43 is of relatively small diameter. The check valve in the passage 43 presents the ingress of water into the cylinder chamber 42. When the cylinder assembly 16 has reached the FIG. 2 position once again, the opened hatch plates 92 will swing under the force of gravity back to the closed position shown whereupon the tool is ready for a further charge cycle to be initiated.

Figure 5A:
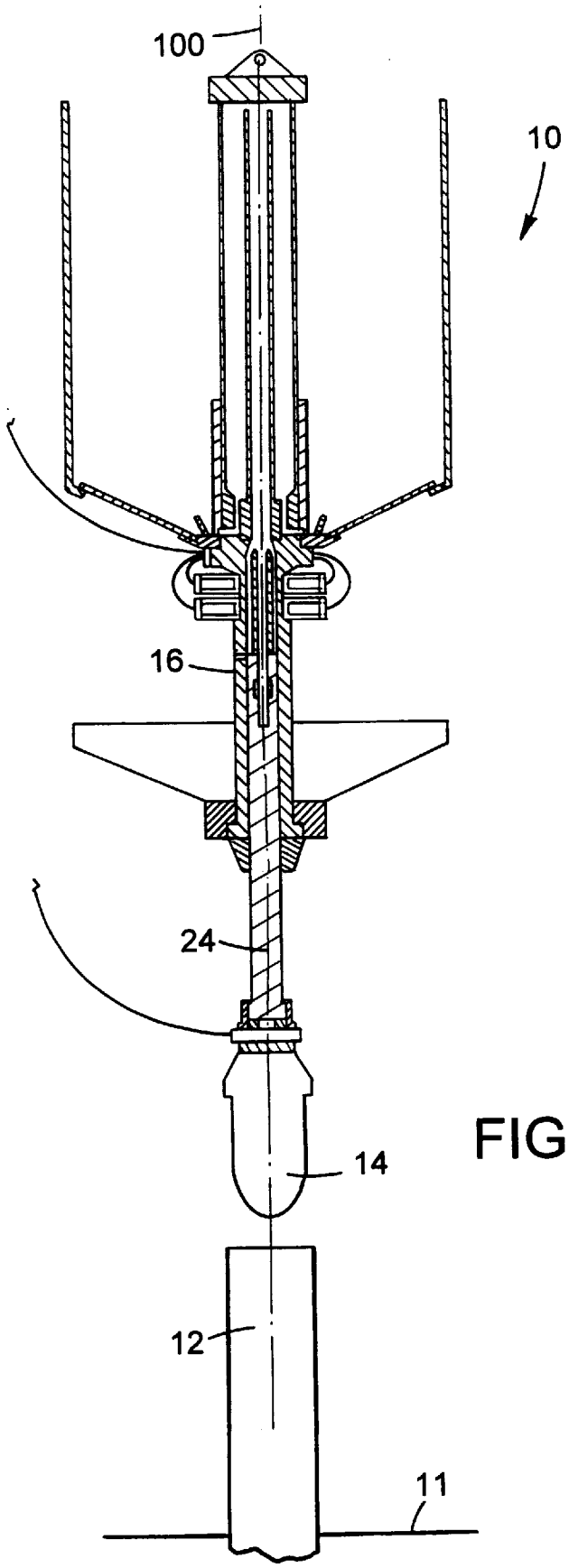
FIGS. 5A through 5E are somewhat schematic views showing the tool in different stages of operation.

The overall system and its operation are illustrated in FIG. 5 wherein FIG. 5A shows the tool being lowered on a wire line 100 to insert the pile cap 14 into the top of the pile 12 which is to be driven into the sub-sea surface formation 11. In this condition the piston 24 is fully extended from the cylinder 16, and the hatch plates 92 can freely swing open to reduce the resistance of the water to the downwards movement of the tool.

Figure 5B:
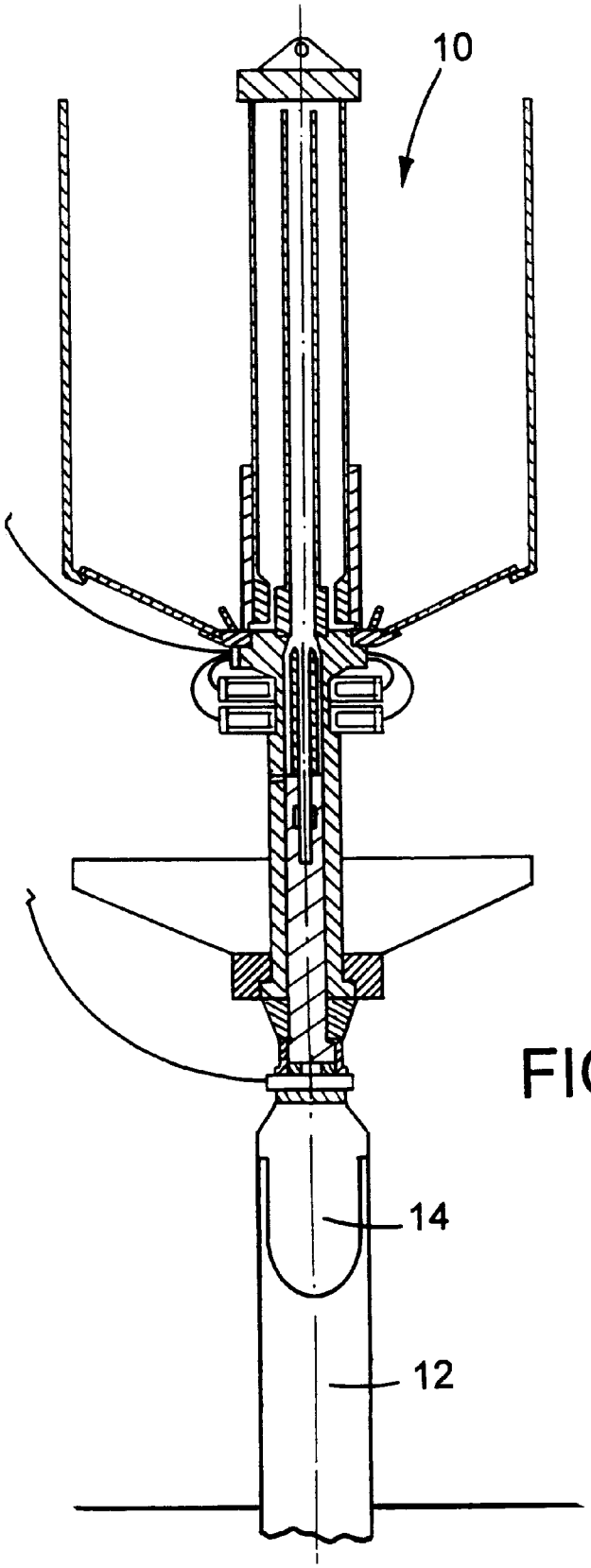

FIG. 5B represents the position which is reached when the pile cap 14 is seated in the top of the pile 12 and the piston 24 has been retracted into the cylinder 16 under the weight of the descending tool 10, the parts then being in the position described in relation to FIG. 2 and the tool being ready for operation.

Figure 5C:
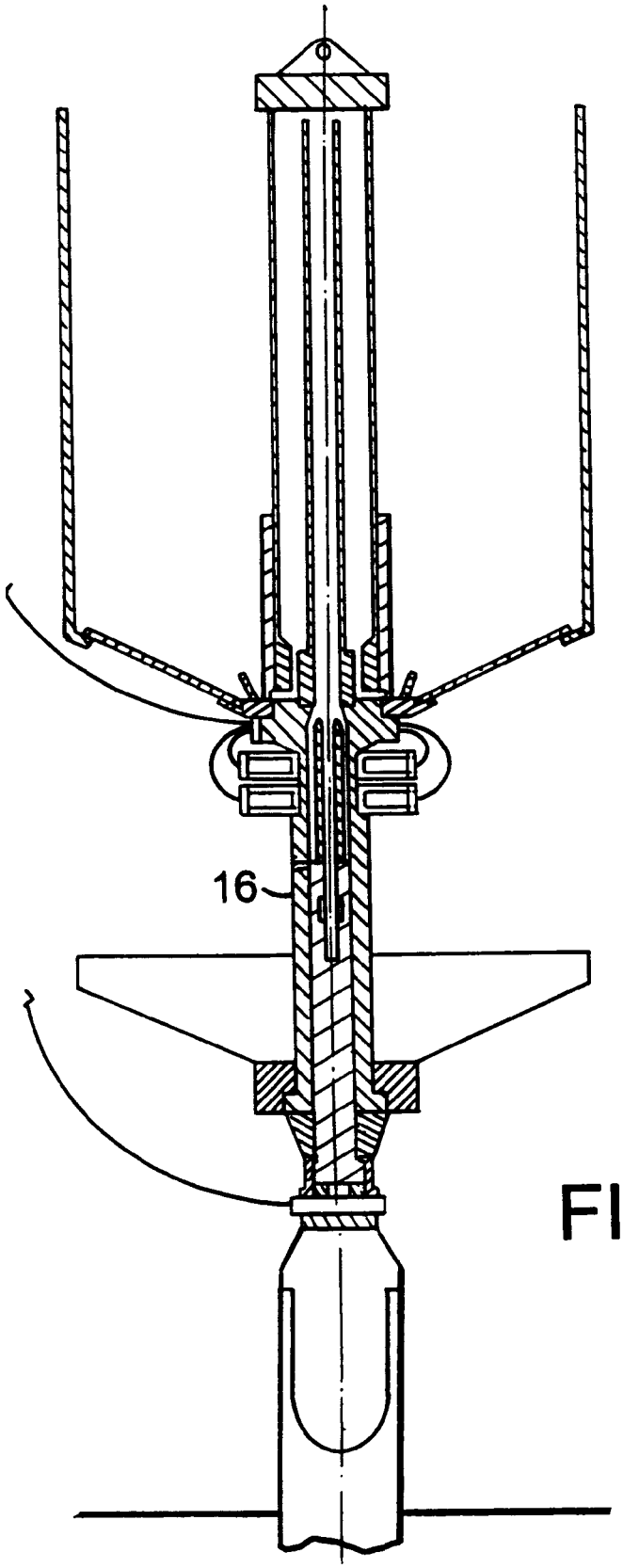

FIG. 5C represents the position which develops after initiation of one of the charges 57 when the downwards thrust has been applied to the pile 12 and the upwards reaction force has pushed the cylinder assembly 16 and its associated parts upwardly.

Figure 5D:
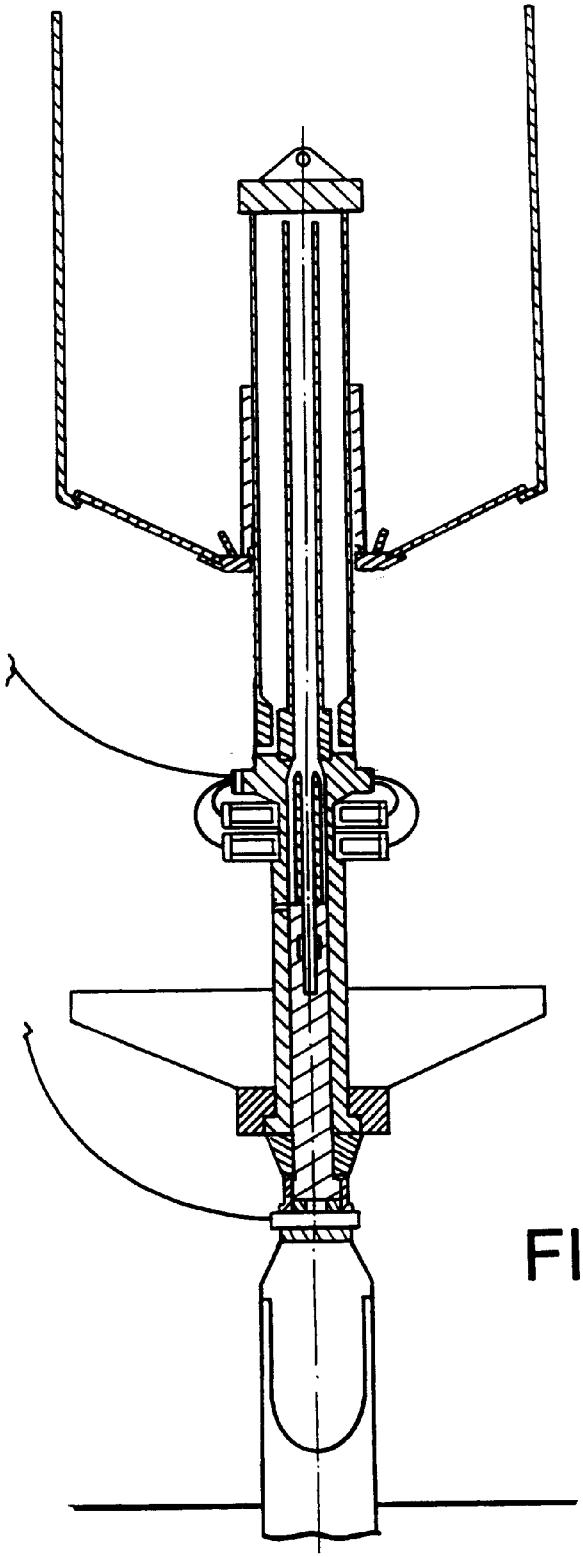

FIG. 5D illustrates the situation which is reached at the end of the expansion stroke of the piston wherein an annular shoulder on the piston comes into contact with the locking collar 26 at the lower end of the cylinder to prevent the piston disengaging from the cylinder. Suitable padding means (not shown) may be provided to cushion the force of impact between the descending piston and the locking collar 26. Engagement with the locking collar terminates upwards movement of the cylinder assembly 16. However the volume of water within the container and the container itself have achieved considerable kinetic energy from the upwards thrusting action, so that even after the cylinder assembly 16 is halted, the container 34 continues its upward motion until the kinetic energy becomes dissipated, this upward motion being accommodated by separation of the hub 84 from its seating on the annular shoulder 86 at the top of the cylinder so that the container can continue to move upwardly, this movement being guided by sliding of the sleeve 78 on the tubular plenum changer 32.

Figure 5E:
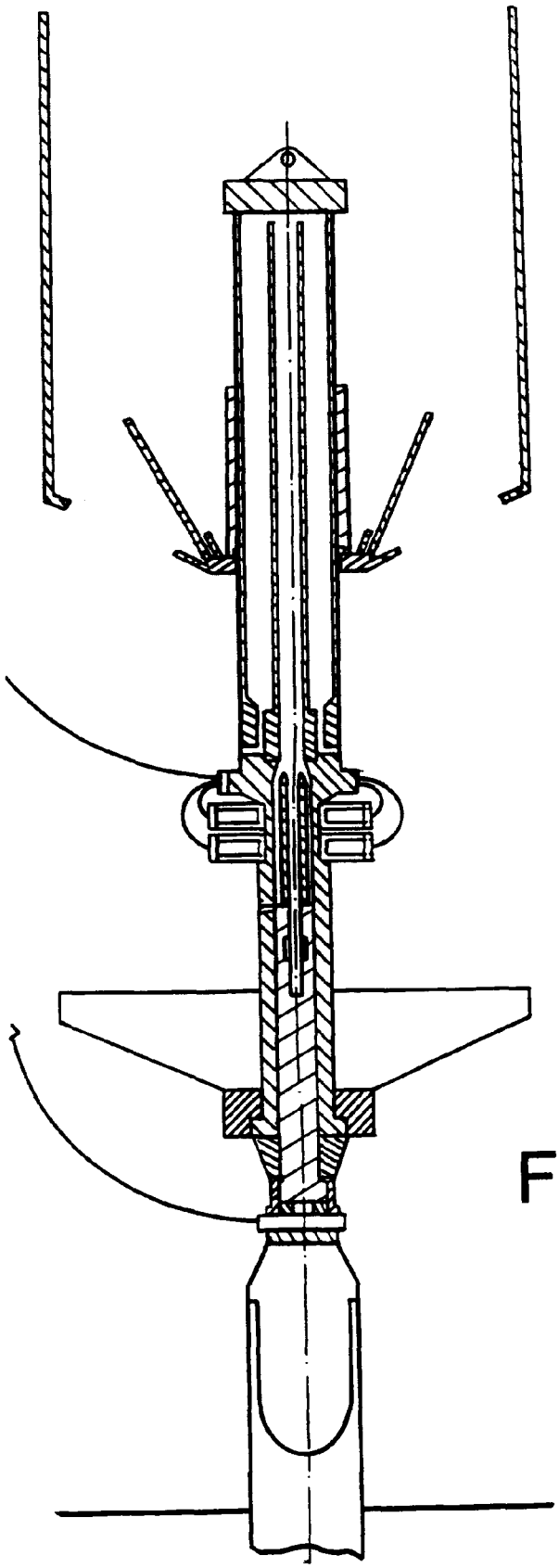

FIG. 5E shows the cylinder assembly and container 34 descending back to the start position after a first cycle has been completed. In this condition the kinetic energy of the container 34 and the contained mass of water has dissipated and the container has commenced to descend under the force of gravity, during this descent the hatch plates 92 being swung open to reduce the water resistance.

The number of charge cylinders 30 employed in any given installation will depend upon the circumstances and in particular the soil resistance, the depth to which the pile has to be driven, the pile diameter, etc. The example shown, for ease of illustration six charge cylinders are illustrated, but clearly this number could be vastly increased should the circumstances warrant.

Although as described in the foregoing the tool is used for installing piles in submerged locations, it will be evident that the tool can very readily be modified and adapted to apply repeated blows to extract a sub-surface foundation element or to apply a torque loading to it. The apparatus can be modified to those purposes as desired.

The system contains instrumentation (not shown) to measure with each charge cycle the force generated and the displacement of the pile, the instrumentation being connected to suitable software to estimate soil resistance.

The tool will also contain ballast tanks (not shown) so that its relative buoyancy can be changed as desired from positive to neutral to negative. When employed in other than the vertical orientation illustrated springs (not shown) or the like are provided to restore the cylinder/piston assembly to its starting position so that in this case there is no need for the movable parts of the tool to have negative buoyancy.

Various other configurations of elements to interact with the water to create the desired inertial and drag resistance forces are conceivable within the scope of the invention as set forth in the attached claims.

We claim:

1. A tool for use in submerged condition for installing piles in a ground formation that is submerged under a body of water, comprising:

a hammer body that is adapted to be fixedly supported relative to and in axial alignment with the head of a pile that is to be driven;

a reaction body carried by said hammer body and guided for movement thereon in a direction that is axial to the pile that is to be driven;

said hammer body and said reaction body respectively defining opposed first and second ends of an expansion chamber that is formed therebetween;

charging means for creating a rapidly expanding volume of high pressure gas within said expansion chamber to generate a downwards pressure force pulse on said expansion chamber first end to drive the pile, an equal and opposite upwards pressure force pulse being applied to said reaction body through said second end of the expansion chamber; and damping structure operatively associated with said reaction body and configured to interact with the water in which the tool is submerged to resist upwards movement of said reaction body in response to such upwards pressure force pulse.

2. A tool as claimed in claim 1 wherein said charging means includes a combustible propellant charge which can be selectively initiated to create said high pressure gas through combustion of said charge.

3. A tool as claimed in claim 2 wherein said propellant charge is contained within a firing chamber which communicates with said expansion chamber through a connecting passage to deliver the high pressure gas thereto upon initiation of the charge.

4. A tool as claimed in claim 3 including a series of said propellant charge containing firing chambers, each said firing chamber communicating with said expansion chamber such that said charges can be initiated at successive intervals to apply a series of downward pressure pulses to the pile.

5. A tool as claimed in claim 4 wherein each said firing chamber communicates with said expansion chamber via a one-way valve which can open to permit flow of gas from said firing chamber to said expansion chamber, but which will prevent return flow.

6. A tool as claimed in claim 4 wherein said firing chambers are carried in a housing that is fixed to said reaction body, said firing chambers being peripherally distributed about said hammer body.

7. A tool as claim in claim 6 wherein each said firing chamber has positioned therein a fuel igniter, said fuel igniters each being coupled to an igniter control on said tool, said igniter control being arranged for actuation from a remote location.

8. A tool as claimed in claim 1 wherein said damping structure includes a large-area surface that extends at least partially transverse to said axial direction for immersion in the body of water to interact with and utilize the inertia of the surrounding water to resist displacement of said reaction body in response to upwards pressure force pulses.

9. A tool as claimed in claim 1 wherein said damping structure includes a large open-top container positioned on said reaction body and sized to confine on the sides and from beneath a large volume of water and thus to utilize the inertia of such large volume of water to resist upwards displacement of the reaction body.

10. A tool as claimed in claim 9 wherein said container has at least one valve port extending upwardly through a lower part of said container, said at least one valve port cooperating with a valve closure which is mounted to permit flow of water through at least one port upwardly but to prevent flow of water through the at least one port downwardly.

* * * * *